US007615919B2

(12) United States Patent
Yang et al.

(10) Patent No.: US 7,615,919 B2
(45) **Date of Patent: *Nov. 10, 2009**

(54) FIELD EMISSION DEVICE WITH TWO LIGHT-PERMEABLE SIDES

(75) Inventors: Yuan-Chao Yang, Beijing (CN); Jie Tang, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/565,533

(22) Filed: Nov. 30, 2006

(65) Prior Publication Data

US 2008/0007153 A1 Jan. 10, 2008

(30) Foreign Application Priority Data

Jul. 5, 2006 (CN) ..... 2006 1 0061511

(51) Int. Cl.
*H01J 63/04* (2006.01)
*H01J 1/62* (2006.01)
*H01J 9/02* (2006.01)

(52) U.S. Cl. ..... 313/496; 313/310; 313/311; 313/497; 313/498; 445/24

(58) Field of Classification Search ..... 313/495–498, 313/306, 309, 310, 293–304, 311, 336, 346 R, 313/351; 445/25, 51
See application file for complete search history.

(56) References Cited

U.S. PATENT DOCUMENTS 6,692,327 B1 * 2/2004 Deguchi et al. ..... 445/49
6,774,548 B2 * 8/2004 Fran et al. ..... 313/309
2003/0042834 A1 * 3/2003 Dean et al. ..... 313/309
2003/0132699 A1 * 7/2003 Yamaguchi et al. ..... 313/496
2005/0194889 A1 * 9/2005 Chen et al. ..... 313/495
2005/0218773 A1 * 10/2005 Ono et al. ..... 313/311
2005/0258728 A1 * 11/2005 Matsuo et al. ..... 313/112
2005/0264157 A1 * 12/2005 Sakai et al. ..... 313/311
2005/0280348 A1 * 12/2005 Chan et al. ..... 313/495
2006/0049737 A1 * 3/2006 Hsiao et al. ..... 313/311
2006/0132048 A1 * 6/2006 Popovich ..... 315/160
2006/0267477 A1 * 11/2006 Hirasawa et al. ..... 313/495
2007/0063630 A1 * 3/2007 Guo et al. ..... 313/311
2008/0018227 A1 * 1/2008 Yang et al. ..... 313/497

* cited by examiner

*Primary Examiner*—Sikha Roy
*Assistant Examiner*—Tracie Green
(74) *Attorney, Agent, or Firm*—Clifford O. Chi

(57) ABSTRACT

A field emission device (10) includes a sealed container (12) with a first light-permeable portion (120) and an opposite second light-permeable portion (122). A first phosphor layer (14) is formed on the first light-permeable portion. A first light-permeable anode (16) is formed on the first light-permeable portion. A second phosphor layer (18) is formed on the second light-permeable portion. A second light-permeable anode (20) is formed on the second light-permeable portion. A shielding barrel (22) is disposed within the container and electrically connected to at least one cathode electrode (25, 26). The shielding barrel has opposite open ends facing toward the first and the second light-permeable portions respectively. The shielding barrel has an inner surface, and a slurry layer (24) containing conductive nano material is formed on the inner surface of the shielding barrel.

17 Claims, 2 Drawing Sheets

FIELD EMISSION DEVICE WITH TWO LIGHT-PERMEABLE SIDES

CROSS-REFERENCE TO RELATED APPLICATIONS

This application is related to commonly-assigned copending application Ser. No. 11/565,528, entitled "FIELD EMISSION DEVICE". Disclosures of the above-identified application are incorporated herein by reference.

BACKGROUND OF THE INVENTION

1. Field of the Invention

The present invention relates to field emission devices, and more particularly to a field emission device.

2. Description of Related Art

Field emission devices are based on emission of electrons in a vacuum. Electrons are emitted from micron-sized tips in a strong electric field, and the electrons are accelerated and collide with a fluorescent material. The fluorescent material then emits visible light. Field emission devices are thin, light weight, and provide high levels of brightness.

Conventionally, a material of the tips is selected from the group consisting of molybdenum (Mo) and silicon (Si). With the development of nano-technology, carbon nanotube (CNT) is also used in the tips of the field emission devices. However, the typical working voltage of such field emission devices is about 10,000 volts, which can easily generate enough static force to break the CNTs. As a result, performance of these field emission devices is unstable.

What is needed, therefore, is a field emission device capable of stable operation.

SUMMARY OF THE INVENTION

A field emission device includes a sealed container with a first light-permeable portion and an opposite second light-permeable portion. A first phosphor layer is formed on the first light-permeable portion. A first light-permeable anode is formed on the first phosphor layer. A second phosphor layer is formed on the second light-permeable portion. A second light-permeable anode is formed on the second phosphor layer. A shielding barrel is disposed within the container and electrically connected to at least one cathode electrode. One opening of the shielding barrel faces towards the first light-permeable portion and the other opening faces towards the second light-permeable portion. The shielding barrel has an inner surface. A conductive nano material layer is formed on the inner surface of the shielding barrel.

BRIEF DESCRIPTION OF THE DRAWINGS

Many aspects of the present field emission device can be better understood with reference to the following drawings. The components in the drawings are not necessarily drawn to scale, the emphasis instead being placed upon clearly illustrating the principles of the present field emission device. Moreover, in the drawings like reference numerals designate corresponding parts throughout the several views.

DETAILED DESCRIPTION OF THE INVENTION

Reference will now be made to the drawings to describe in detail the preferred embodiment of the field emission device.

Figure 1:
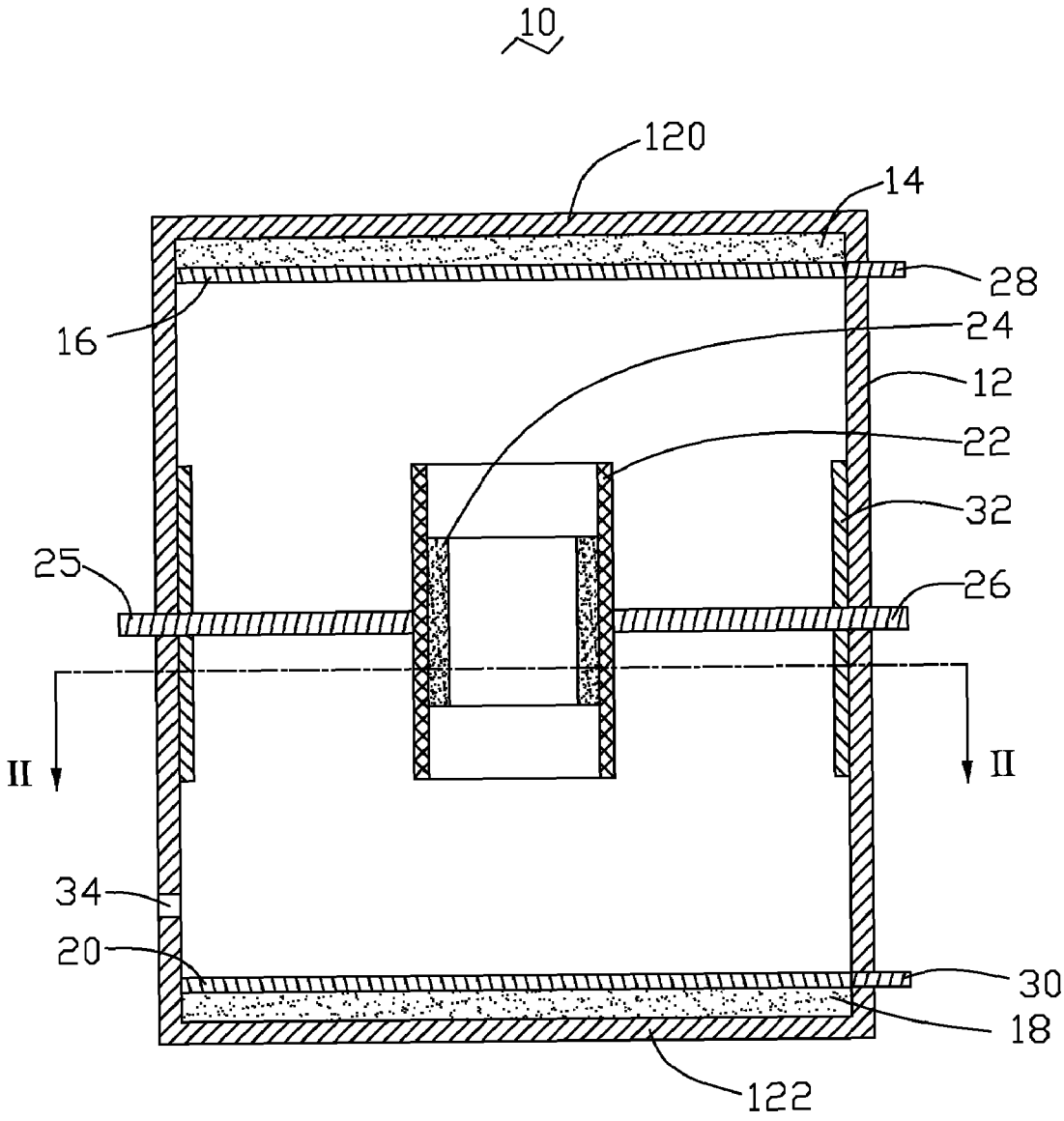
FIG. 1 is a schematic, cross-sectional view of a filed emission device in accordance with a first embodiment.
Figure 2:
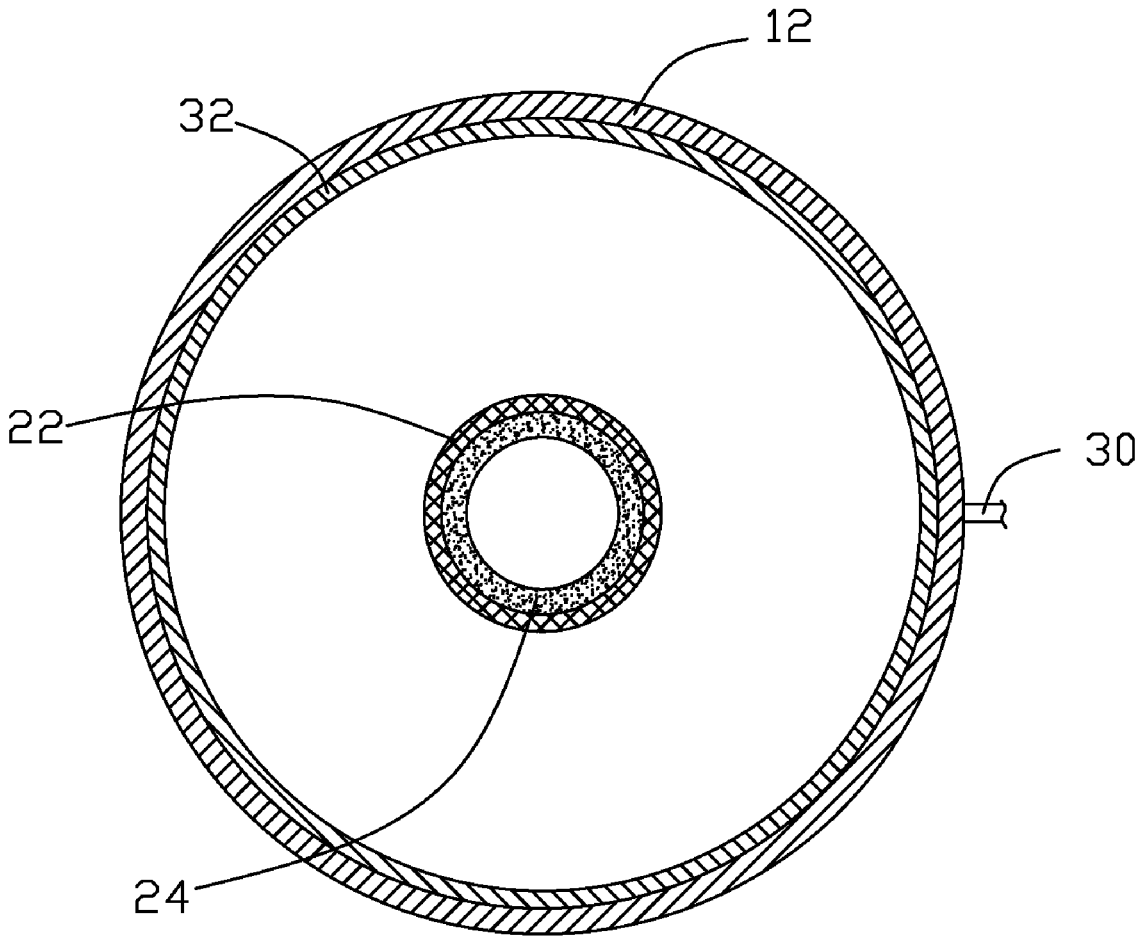
FIG. 2 is a schematic, cross-sectional view of the filed emission device from FIG. 1 taken along the line II-II.

Referring to FIGS. 1 and 2, a field emission device 10 includes a first light-permeable portion 120, a second light-permeable portion 122, and a sealed container 12. The sealed container 12 encloses a first light-permeable anode 16, a second light-permeable anode 20 and a shielding barrel 22. First and second phosphor layers 14, 18 are deposited on the first and the second light-permeable portions 120, 122 respectively. The first and the second phosphor layers 14, 18 contain fluorescent material that can emit white or colored light when being bombarded with electrons. The first and the second light-permeable anodes 16, 20 are formed on the first and the second phosphor layers 14, 18 respectively. The shielding barrel 22 is disposed within the sealed container 12. The shielding barrel 22 has opposite openings respectively facing toward the first and second light-permeable portions 120, 122. A conductive nano-material layer 24 is formed on an inner surface of the shielding barrel 22. The shielding barrel 22 is connected with at least one cathode electrode. In the illustrated embodiment, the shielding barrel 22 is connected with two cathode electrodes 25, 26. The at least one cathode electrode 25, 26 surrounds the shielding barrel 22. The first and the second light-permeable anodes 16, 20 and the terminals are electrically connected with a first anode wire 28 and a second anode wire 30 respectively, which lead (i.e., run) from the inside to outside of the sealed container 12. The first and the second anode wire 28, 30 as well as the cathode electrodes 25, 26 are electrically connected with respective terminals for enabling application of an electric field over the shielding barrel 22 and the first and the second light-permeable anodes 16, 20.

The sealed container 12 is a hollow member that defines an inner space, the inner space being held in a vacuum. The main portion of the sealed container 12 in cross-section can be, for example, a circle, a quadrangle, a triangle, or a polygon. In the illustrated embodiment, the main portion of the sealed container is a cylinder. The first and the second light-permeable portions 120, 122 may be a planar surface, a spherical surface, or an aspherical surface, and can be selected according to application. The sealed container 12 is light-permeable, and preferably transparent. The sealed container 12 according to the embodiment can be made of a nonmetal material, for example, quartz or glass. Such materials as quartz or glass are beneficial in that they are electrically insulative.

The first and the second light-permeable anodes 16, 20 are metal films with good electric conductivity. In the preferred embodiment, the anodes 16, 20 are aluminum films. In the illustrated embodiment, the shielding barrel 22 is a cylinder with a central axis perpendicular to the first and the second light-permeable portions 120, 122. It can be understood that other shapes of the shielding barrel 22 can be selected according to the shape of the sealed container 12.

The conductive nano-material layer 24 comprises a material selected from the group consisting of carbon nanotubes, carbon nano-sticks, carbon nano-yarns, Buckminsterfullerenes (C60), carbon nano-particles. The conductive nano-material layer 24 can also be made of a material selected from the group consisting of nanotubes, nano-sticks, nano-yarns, nano-particles of conductive metal and semiconductors. In the preferred embodiment, the conductive nano-material layer 24 consists of carbon nanotubes. Firstly, the nano slurry is spread on the inner surface of the shielding barrel 22 and solidified. Then the conductive nano-material 24 is scrubbed with a rubber to expose ends of the carbon nano tubes so that the conductivity of the shielding barrel 22 can be enhanced. Distance between edge (e.g., top end) of the conductive nano-material layer 24 and edge (e.g., top end) of the shielding barrel 22 determines shielding effect of the shielding barrel 22. The distance is bigger; the effect is more apparently.

In order to maintain the vacuum of the inner space of the sealed container 12, a getter 32 may be arranged therein to absorb residual gas inside the sealed container 12. The getter 32 should preferably be arranged on an inner surface of the sealed container 12 around the electrodes 25, 26. The getter 32 may be evaporable getter introduced using high frequency heating. The getter 32 also can be non-evaporable getter. It must be ensured that the getter 32 does not attach to the light-permeable anodes 16, 20 in order to avoid short circuits between the light-permeable anode 16, 20 and the electrodes 25, 26.

The sealed container 12 further includes an air vent 34. The air vent 34 connects a vacuum pump to vacuum the sealed container 12 before packaging sealing the container.

In operation, when putting a voltage over the electrodes 25, 26 and the light-permeable anodes 16, 20, electrons will emanate from two openings of the shielding barrel 22. The electrons move towards and transmit through the first and the second light-permeable anodes 16, 20. When the electrons hit the first and second phosphor layers 14, 18 visible lights will be emitted. One part of the lights will transmit through the first and the second light-permeable portions 120, 122, and the other part of the lights will be reflected by the first and the second light-permeable anodes 16, 20, and spread out of the light-permeable portions 120, 122. A plurality of such tubes 10 can be arranged together to use for lighting and two-sided displaying. Because of the shielding effect of the shielding barrel, the field emission device can operate with greater stability at higher voltages.

While the present invention has been described as having preferred or exemplary embodiments, the embodiments can be further modified within the spirit and scope of this disclosure. This application is therefore intended to include any variations, uses, or adaptations of the embodiments using the general principles of the invention as claimed. Further, this application is intended to include such departures from the present disclosure as come within known or customary practice in the art to which the invention pertains and which fall within the limits of the appended claims or equivalents thereof.

What is claimed is:

1. A field emission device, comprising:

a sealed container with a first light-permeable portion and an opposite second light-permeable portion;

a first phosphor layer formed on the first light-permeable portion;

a first light-permeable anode formed on the first phosphor layer;

a second phosphor layer formed on the second light-permeable portion;

a second light-permeable anode formed on the second phosphor layer;

a shielding barrel located within the sealed container and electrically connected to at least one cathode electrode, the shielding barrel having two opposite openings facing toward the first and the second light-permeable portions, the shielding barrel having an inner surface;

a conductive nano-material layer, the conductive nano-material layer located on at least a portion of the inner surface of the shielding barrel such that a hollow area is present in the shielding barrel with the conductive nano-material layer thereon.

2. The field emission device as claimed in claim 1, wherein the sealed container is a vacuum container.

3. The field emission device as claimed in claim 1, wherein the sealed container is a hollow cylinder.

4. The field emission device as claimed in claim 1, wherein the sealed container is comprised of a material selected from the group consisting of quartz, glass and any combination thereof.

5. The field emission device as claimed in claim 1, wherein the first and the second light-permeable portion is flat, spherical, or aspherical in shape.

6. The field emission device as claimed in claim 1, wherein the first and the second light-permeable anodes are aluminum layers.

7. The field emission device as claimed in claim 1, wherein the conductive nano-material layer is comprised of a material selected from the group consisting of carbon nanotubes, carbon nano-sticks, carbon nano-yarns, Buckminster-fullerene, and carbon nano-particles.

8. The field emission device as claimed in claim 1, wherein the conductive nano-material layer is made of a material selected from the group consisting of nanotube, nano-stick, nano-yarn, and nano-particle of at least one of conductive metal and semiconductor.

9. The field emission device as claimed in claim 1, further comprising a getter formed on the inner surface of sealed container and arranged around the at least one cathode electrode.

10. The field emission device as claimed in claim 1, wherein the at least one cathode electrode is arranged between the first and second light-permeable anodes.

11. The field emission device as claimed in claim 1, wherein the at least one cathode electrode surrounds the shielding barrel.

12. The field emission device as claimed in claim 1, wherein central axis of the container is perpendicular to a surface of the first and the second light-permeable portions.

13. The field emission device as claimed in claim 1, wherein the two opposite openings of the shielding barrel face towards the first and second light-permeable anodes.

14. The field emission device as claimed in claim 1, wherein the inner surface of the shielding barrel includes an intermediate portion and a peripheral exposed portion adjacent to the light-permeable anode, and the conductive nano-material layer is formed on the intermediate portion but not on the peripheral exposed portion.

15. The field emission device as claimed in claim 1, wherein the first phosphor layer is sandwiched between the first light-permeable portion and the first light-permeable anode.

16. The field emission device as claimed in claim 1, wherein a distance exists between top edges of the conductive nano-material layer and the shielding barrel.

17. The field emission device as claimed in claim 16, wherein a second distance exists between bottom edges of the conductive nano-material layer and the shielding barrel.

* * * * *